US008955274B2

(12) United States Patent
Brandão et al.

(10) Patent No.: US 8,955,274 B2
(45) Date of Patent: Feb. 17, 2015

(54) WINDBREAK SUPPORTING TOWER FOR REDUCING THE SPEED OF NATURAL WIND ON OPEN-AIR ORE STACKS

(71) Applicants: Metalvix Engenharia E Consultoria Ltda, Vitoria (BR); MCA Tecnologia de Estruturas Ltda, Vitoria (BR)

(72) Inventors: José Emílio Brandão, Vitoria (BR); Carlos Alberto Pinto Montenegro, Vitoria (BR); Carlos Augusto Calmon Nogueira Da Gama, Vitoria (BR); Carlos Eduardo Calmon Nogueira Da Gama, Vitoria (BR)

(73) Assignees: Metalvix Engenharia E Consultoria Ltda, Vitoria—ES (BR); MCA Technologia de Estruturas Ltda, Vitoria—ES (BR)

( * ) Notice: Subject to any disclaimer, the term of this patent is extended or adjusted under 35 U.S.C. 154(b) by 0 days.

(21) Appl. No.: 14/352,460

(22) PCT Filed: Sep. 18, 2012

(86) PCT No.: PCT/BR2012/000356
§ 371 (c)(1),
(2) Date: Apr. 17, 2014

(87) PCT Pub. No.: WO2013/056324
PCT Pub. Date: Apr. 25, 2013

(65) Prior Publication Data

US 2014/0237914 A1 Aug. 28, 2014

(30) Foreign Application Priority Data

Oct. 19, 2011 (BR) ..... 1105449

(51) Int. Cl.
*E04C 5/08* (2006.01)
*E04H 12/16* (2006.01)
(Continued)

(52) U.S. Cl.
CPC ..... *E04H 12/16* (2013.01); *E04H 12/10* (2013.01); *E04H 12/20* (2013.01); *E02D 27/42* (2013.01)
USPC ..... 52/223.14; 52/169.9; 52/638; 52/651.01

(58) Field of Classification Search
USPC ..... 52/169.9, 646, 648.1, 653.1, 653.2, 52/638, 651.01, 651.07, 651.11, 223.14; 135/159, 123, 135, 127, 99
See application file for complete search history.

(56) References Cited

U.S. PATENT DOCUMENTS 3,063,521 A * 11/1962 Fuller ..... 52/646
3,169,611 A * 2/1965 Snelson ..... 52/648.1
(Continued)

FOREIGN PATENT DOCUMENTS

CN 201141221 Y 10/2008
CN 201225026 Y 4/2009
(Continued)

OTHER PUBLICATIONS

International Search Report issued in corresponding application No. PCT/BR2012/000356, mailed Nov. 13, 2012.

*Primary Examiner* — James Ference
(74) *Attorney, Agent, or Firm* — Carter, DeLuca, Farrell & Schmidt, LLP

(57) ABSTRACT

A windfence supporting tower with tension-integrity, includes a tubular metal tower having a central tubular post and four inclined tubular structural tensile elements attached to the post via the coupling ring and the lower ends attached to the free ends of a yoke of compression tubes, which is in turn attached to the post by the reaction flange of the yoke, further receiving at the free ends of the yoke four vertical tensile structural elements which are tensioned and anchored to the ground through four independent foundations located around the foundation of the central tube. These vertical ties pull on the connection point of the yoke and in turn the inclined structural elements connected to the coupling ring, thereby providing stability with tension-integrity, which is the main feature of the present supporting tower for absorbing forces caused by the wind.

2 Claims, 2 Drawing Sheets

(51) Int. Cl.

| | |
|---|---|
| ***E04H 12/10*** | (2006.01) |
| ***E04H 12/20*** | (2006.01) |
| ***E02D 27/42*** | (2006.01) |

(56) References Cited

U.S. PATENT DOCUMENTS

| | | | | | |
|---|---|---|---|---|---|
| 3,226,091 | A | * | 12/1965 | Root | 256/12.5 |
| 3,611,652 | A | * | 10/1971 | Rabenhorst et al. | 52/110 |
| 3,634,989 | A | * | 1/1972 | Rogers | 52/651.09 |
| 3,866,366 | A | * | 2/1975 | Fuller | 52/81.2 |
| 4,334,391 | A | * | 6/1982 | Hedgepeth et al. | 52/108 |
| 4,627,333 | A | * | 12/1986 | Anderson et al. | 454/178 |
| 5,072,555 | A | * | 12/1991 | Geiger | 52/82 |
| 5,485,863 | A | * | 1/1996 | Carter | 135/145 |
| 5,632,292 | A | * | 5/1997 | Carter | 135/145 |
| 5,832,688 | A | * | 11/1998 | Crissey et al. | 52/651.01 |
| 5,930,971 | A | * | 8/1999 | Etheridge | 52/646 |
| 5,934,301 | A | * | 8/1999 | Carter | 135/145 |
| 6,397,872 | B1 | * | 6/2002 | Carter | 135/145 |
| 6,708,707 | B2 | * | 3/2004 | Dotterweich et al. | 135/131 |
| 6,857,246 | B2 | * | 2/2005 | Erbetta et al. | 52/653.2 |
| 6,901,714 | B2 | * | 6/2005 | Liapi | 52/645 |
| 6,929,017 | B2 | * | 8/2005 | Byun | 135/145 |
| 7,703,469 | B2 | * | 4/2010 | Danziger | 135/147 |
| 2002/0170588 | A1 | * | 11/2002 | Seo | 135/90 |
| 2003/0051749 | A1 | * | 3/2003 | Baughman et al. | 135/87 |

FOREIGN PATENT DOCUMENTS

| | | | |
|---|---|---|---|
| EP | 0154577 | A1 | 9/1985 |
| JP | 56048311 | A | 5/1981 |
| JP | 58059106 | A | 4/1983 |
| JP | 1250507 | A | 10/1989 |

* cited by examiner

WINDBREAK SUPPORTING TOWER FOR REDUCING THE SPEED OF NATURAL WIND ON OPEN-AIR ORE STACKS

CROSS REFERENCE TO RELATED APPLICATIONS

This application is a U.S. National Phase Application of International Patent Application No. PCT/BR2012/000356, filed Sep. 18, 2012, which claims priority from Brazilian Patent Application No. PI 1105449-2 filed on Oct. 19, 2011, the disclosures of each of which are hereby incorporated by reference herein in their entirety.

FIELD OF THE INVENTION

The present invention relates to a new windbreak supporting tower for reducing the speed of natural wind on open-air ore stacks with tension-integrity capable of supporting high loads of wind applied to the windbreak fences of the system known as 'windfence', also designated as towers of deviation, and which is characterized by comprising only a few construction elements and providing lower physical and visual interferences in stock patios of mineral ores and granulates.

BACKGROUND OF THE INVENTION

Fences ('windfence') have been recently used for reducing the speed of natural wind on open-air ore stacks in patios of pelletizing plants. This is now a necessity due to the increasing enforcement of environmental protection laws and pollution control to the iron ore industry and other industrial fields which require large open-air stock patios for granulated mineral ores. The vertical support of windfences, which completely surround patios containing iron ore powder is made by latticed metal towers arranged on the boundaries of these patios.

Even though these towers serve the function to which they are intended, they are made of latticed steel sections (L, U, C, I or tubular sections) in a total of 55 to 60 welded elements weighting approximately 3.90 T to 10.8 T, with an average weight of 7.60 T per tower. They have base dimensions of =smaller tower (2.53×3.02 m triangular-shaped) and larger tower (4.31×3.45 m triangular-shaped) and height dimensions of =smaller tower (14.96 m) and larger tower (29.52 m) with an average height of (26.90 m). Besides, they require large concrete bases of the order of 50 $m^3$ with dimensions of (5×5×2 m). These bases, in addition to having a significant cost, generate undesirable interferences with water, compressed air, gas and cable manifolds passing on the perimeter of mineral ore patios. Owing to these technical features, the currently existing windfence supporting towers have high manufacture, assembly and installation costs, as well as they require the adaptation of tube networks and manifolds passing on the perimeter of mineral ore patios. In addition, base dimensions of the current tower have a concrete volume about 5 times as great as the tower with tension-integrity that is the object of the present patent application.

Current windfence supporting towers may cause some inconveniences in installation areas, such as:

- Obstruction of parts of streets and entrances;
- Greater tendency of interfering with buried mechanical and electrical elements and/or components;
- Extended term for execution, thus implying in larger periods of patio interdiction.

THE PRESENT INVENTION

Therefore, the objective of the present invention is to provide a windfence supporting tower lacking the aforementioned disadvantages, comprising a tubular metal tower formed by a central tubular post and four inclined, structural tensile elements with the upper ends fastened to the post by means of a coupling ring surrounding it and the lower ends being fastened to the free ends of four yoke arms of compression tubes, which tubes have their four inner ends attached to the reaction flange of the yoke. Said flange is jointed to the central tubular post. Over the coupling ring, the central tubular post has an upper free height.

The outer end of each of the four bars comprising the yoke of compression bars, which supports four inclined structural tensile elements and separates them from the central post, also has at this point another connection to receive the four vertical tensile structural elements, which by means of tensioners are tensioned and anchored to the ground at four independent foundations located around the foundation of the central tube.

These vertical ties pull on the connection point of the yoke and in turn the inclined structural elements connected to the coupling ring, thereby providing stability with tension-integrity, which is the main feature of the present supporting tower for absorbing forces caused by the wind.

The vertical support of the windfence is located at sites equally spaced along the height of the compression structural member, the central tubular post.

Such towers with tension-integrity are spaced from 6 to 30 m apart along the ore patios and have a height of 15 to 30 m.

Another feature of the tower with tension-integrity is that the foundation thereof comprises a central base and four points of anchorage to the ground, which makes it easier to solve the interference problem as compared to the foundation block used in current towers.

A) Preferably the four inclined tensile structural elements are tubular cylindrical bars having the upper end attached to the coupling ring and the bottom end attached to the yoke of four tubular compression bars, which, in continuity, are each connected to the ground through four vertical tensile cylindrical bars, which individually are pre-tensioned during assembly by their bottom ends connected to lower tensioners, which are in turn individually anchored to the ground.

B) In a preferred embodiment, the reaction flange of the yoke is located at two fifths of the height of the central tubular post, the coupling ring of tensile forces with the central tubular post is located at four fifths of its height and the uppermost attachment point of the windfence at the free end of the central tubular post, over the coupling ring, is located at a distance equivalent to one fifth of the height of the central post.

C) In another preferred embodiment, the vertical tensile cylindrical bars, unlike B), are tensioned by their upper end by way of upper tensioners attached to the yoke of compression bars. The lower ends of each of the vertical tensile cylindrical bars are anchored directly to the ground.

BRIEF DESCRIPTION OF DRAWING

The invention will be better understood based upon the disclosure of the appended drawings where.

DETAILED DESCRIPTION OF THE DRAWINGS

FIGS. 1*a-d* depict lattice metal towers 10 of the current state of the art, which comprise from 55 to 60 steel sections with an average weight of 7.60 T. The triangular-shaped base 11 requires a concrete block 12 of the order of 50 $m^3$ with dimensions of (5×5×2 m).

Figure 1A:
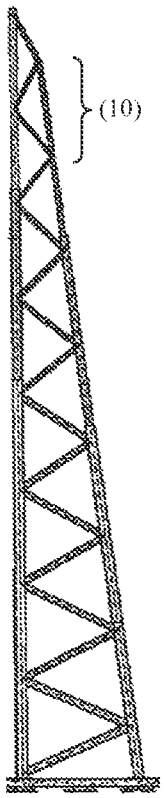
FIG. 1a PRIOR ART
FIG. 1*a* illustrates a side view of the lattice tower for windfence attachment for reducing the speed of natural wind of the current state of the art.
Figure 1B:
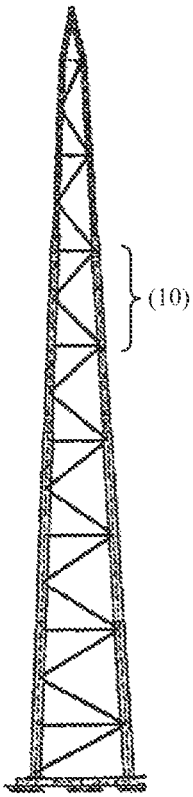
FIG. 1b PRIOR ART
FIG. 1*b* illustrates a bottom view of the lattice tower for windfence attachment for reducing the speed of natural wind of the current state of the art.
Figure 1C:
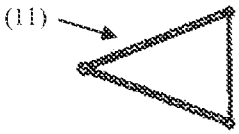
FIG. 1c PRIOR ART
FIG. 1*c* illustrates a top plan view of the lattice tower for windfence attachment for reducing the speed of natural wind of the current state of the art.
Figure 1D:
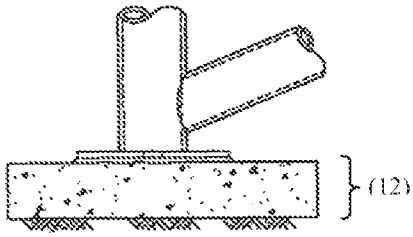
FIG. 1d PRIOR ART
FIG. 1*d* illustrates an enlarged detail of the left lower part of FIG. 1*a*.
Figure 2:
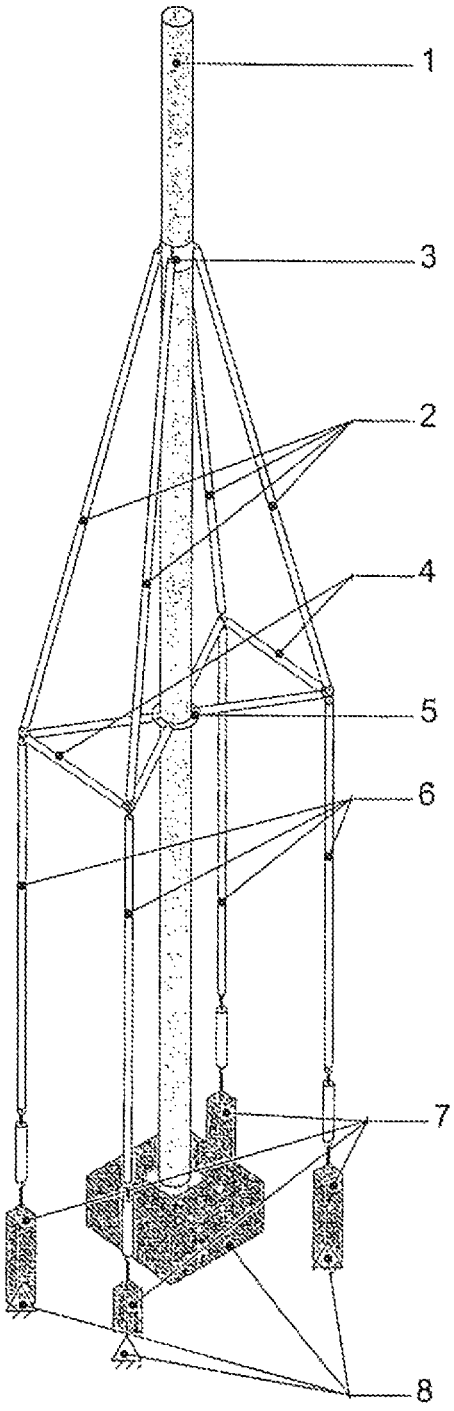
FIG. 2 illustrates the tower with tension-integrity of one embodiment of the present invention.

FIG. 2 illustrates one embodiment of the present invention, which is a tubular metal tower comprising: a central tubular post 1, four inclined tensile structural elements 2 formed of tubular cylindrical bars, a ring 3 coupling the upper ends of the bars with the central post, a compression yoke 4 formed of tubular bars with four horizontal arms which receive at their external connections the lower ends of the inclined tubular cylindrical bars 2, a reaction flange of the yoke 5 fixed to the central post, which receives the four inner ends of the arms of the yoke of tubular bars, four vertical tensile structural elements 6 connected to the outer ends of the yoke and having lower ends tensioned by tensioners 7 anchored to the ground at four independent foundations 8 located around the central tube foundation 8, the tubular central post having an upper free height over the coupling ring 3 and also, stability with tension-integrity, which is characteristic to the present tower for supporting wind forces, is applied by tensioners 7 tensioning the vertical structural elements 6 attached to the yoke 5 which, in turn, transmits said tensile force to the inclined structural elements attached to the coupling ring 3 where they are balanced by the compression reaction of the central post.

According to another feature of the windbreak supporting tower of the invention, the reaction flange of the yoke 5 is located at two fifths of the height of the central tubular post 1, the coupling ring of tensile forces 3 with the central tubular post 1 is located at four fifths of its height and the uppermost attachment point of the windfence at the free end of the central tubular post, over the coupling ring, is located at a distance equivalent to one fifth of the height of the central post 1.

According to yet another feature of the windbreak supporting tower of the invention, the vertical tensile cylindrical bars 6 are tensioned by its upper end by way of tensioners 9 attached to the yoke of tubular compression bars 4. The lower ends of each of the vertical tensile cylindrical bars are anchored directly to the ground.

The invention claimed is:

1. A windbreak supporting tower for reducing the speed of natural wind on open-air stacks of mineral ore, the tower being a tubular metal tower, comprising:

a central tubular post anchored to a central tube foundation;

four inclined tensile structural elements;

a coupling ring disposed about the central tubular post and coupling the inclined tensile structural elements to the central tubular post at a position spaced-apart from a free end of the central tubular post;

a yoke of compression bars coupled to the inclined tensile structural elements;

a reaction flange of the yoke coupling the yoke to the central tubular post;

four vertical tensile structural elements coupled to the yoke; and four tensioners, each tensioner coupled to a respective one of the vertical tensile structural elements, the tensioners being anchored to independent foundations around the central tube foundation to apply tension to the vertical tensile structural elements.

2. The windbreak supporting tower of claim 1, wherein the reaction flange of the yoke is located at two fifths of a height of the central tubular post, and the coupling ring is located at four fifths of the height of the central tubular post.

* * * * *